US005682093A

United States Patent [19]

Kivela

[11] Patent Number: 5,682,093

[45] Date of Patent: Oct. 28, 1997

[54] APPARATUS AND METHOD FOR REDUCING THE POWER CONSUMPTION OF AN ELECTRONIC DEVICE

[75] Inventor: Seppo Kivela, Salo, Finland

[73] Assignee: Nokia Mobile Phones Ltd., Salo, Finland

[21] Appl. No.: 628,931

[22] Filed: Apr. 8, 1996

[30] Foreign Application Priority Data

Apr. 12, 1995 [FI] Finland ..... 951767

[51] Int. Cl.[6] ..... G05F 1/44

[52] U.S. Cl. ..... 323/273; 323/303

[58] Field of Search ..... 323/269, 273, 323/276, 280, 281, 303, 268; 455/31.1, 73, 127, 343; 320/21

[56] References Cited

U.S. PATENT DOCUMENTS

| | | | |
|---|---|---|---|
| 4,384,361 | 5/1983 | Masaki | 455/31 |
| 4,523,332 | 6/1985 | Mori | 455/343 |
| 4,555,660 | 11/1985 | von Winnicki | 323/224 |
| 4,613,809 | 9/1986 | Skovmand | 323/268 |
| 4,692,688 | 9/1987 | Stanojevic | 323/285 |
| 4,885,522 | 12/1989 | Konopka | 320/21 |
| 4,906,913 | 3/1990 | Stanojevic | 323/303 |
| 5,028,861 | 7/1991 | Pace et al. | 323/222 |
| 5,179,724 | 1/1993 | Lindoff | 455/76 |
| 5,208,494 | 5/1993 | Ikonen et al. | 307/572 |
| 5,216,353 | 6/1993 | Mori | 323/266 |
| 5,241,278 | 8/1993 | Bitar | 324/635 |
| 5,241,284 | 8/1993 | Nyqvist et al. | 330/297 |
| 5,291,542 | 3/1994 | Kivari et al. | 379/58 |
| 5,378,935 | 1/1995 | Korhonen et al. | 327/114 |
| 5,416,435 | 5/1995 | Jokinen et al. | 327/113 |
| 5,471,655 | 11/1995 | Kivari | 455/127 |
| 5,493,203 | 2/1996 | Dalton | 323/282 |

FOREIGN PATENT DOCUMENTS

0511819 A1 11/1992 European Pat. Off. .

OTHER PUBLICATIONS

Japanese Patent Abstract No. 63–211007Furukawa Electric Co. Ltd., Hashimoto Application No. 62–43083, Constant Voltage Power Circuit Sep. 1988.

*Primary Examiner*—Adolf Berhane
*Attorney, Agent, or Firm*—Perman & Green, LLP

[57] ABSTRACT

The invention relates to a method for reducing power consumption in an electronic device which includes a voltage regulator that has a transistor (T1) connected in series as regards the load current. The invention also relates to such a regulator and an electronic device using such a regulator. The base current (Ib) of the series transistor (T1) of the regulator is arranged to have different values according to how big a load current is required of the regulator. For that purpose, the regulator includes an extra intermediate input (Vsx) which switches the base current (Ib) to be conducted through an alternative current path (Re2, D1, T4) when the maximum load current is required.

15 Claims, 4 Drawing Sheets

APPARATUS AND METHOD FOR REDUCING THE POWER CONSUMPTION OF AN ELECTRONIC DEVICE

Figure 1:
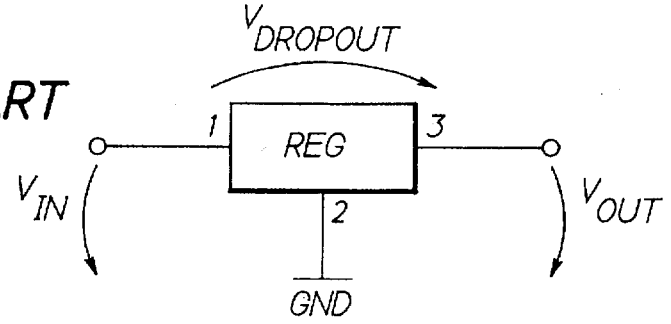
FIG. 1 PRIOR ART

The present invention relates to a method for reducing the power consumption of an electronic device, preferably a battery-powered device, which includes at least one voltage regulator, and it also relates to an electronic device which includes at least one voltage regulator, and it also relates to a voltage regulator.

Nowadays consumers are offered a wide variety of battery-powered devices. Such devices include e.g. mobile phones, portable computers, portable fax machines, portable photocopiers, portable oscilloscopes and other portable instruments, as well as e.g. portable hospital equipment and so on. So there are several choices. The present invention can be utilized in any electronic device, especially battery-powered device, and it is therefore not restricted to any particular device. The term battery in this context means any component storing up electric energy, such as a rechargeable battery or a non-rechargeable battery or accumulator or similar device.

To illustrate the range of use and the advantages of the invention as well as the disadvantages of prior art, we will use a battery-powered mobile phone as an example of an electronic device.

A cellular telephone system, such as the GSM, usually comprises several base stations each of which serves a predetermined geographical area, or cell. Each base station sends messages to several mobile stations in the area of the cell. Mobile stations include a microprocessor and a transceiver and decoder controlled by the microprocessor. In battery-powered mobile stations the battery operating time may be 40 hours in the standby state and one to two hours in the active state during which the phone is transmitting and receiving data and/or speech. When the battery has been discharged, it must be replaced or recharged.

The time-division multiple access (TDMA) based GSM system is not described here in greater detail because it is known to one skilled in the an and the system is specified in the so-called GSM specifications and disclosed e.g. in the publication "M. R. L Hodges. The GSM radio interface, British Telecom Technological Journal", Vol. 8, No 1. 1990, pp. 31–43.

In mobile phones it is known a so-called current-saving state in which the circuits controlling the operation of the mobile phone, such as the microprocessor, are switched into the current-saving state, and in the current-saving state clock frequencies are decreased and some of the clocks are even stopped. In the European patent document EP-473465 it is disclosed the utilization of the current-saving state. In cellular mobile telephone systems most of the messages sent to mobile stations by base stations are mobile station specific, so only a small part of the messages sent by a base station are meant for a particular mobile station. In order for a mobile station not to continuously receive and decode all messages sent by the base station, the European patent document EP-473465 proposes that to save power the messages coming to a mobile station are detected to see if a particular received message is meant for another mobile station and if it is, the battery power is decreased (the current-saving state is activated) until the next message sent by the base station to that mobile station is expected to arrive. The saving of current according to EP-473465 is based on a two-part message reception, with the first part indicating whether or not that message is meant for another mobile station and this message meant for another mobile station includes a second part which, according to EP-473465, need not be received if the message is addressed to another mobile station. So, the mobile station can switch a major part of its receiving circuits into the current-saving state until the next message possibly meant for that particular mobile station is expected to arrive. The current-saving period is controlled by a timing circuit into which a new reception starting time may be programmed.

Most electronic devices need different operating voltages for different parts of the device, and to generate and stabilize different operating voltages it is usually used voltage regulators. The couplings and operation of a regulator are illustrated by the simplified diagram in FIG. 1 where the regulator is depicted as a three-port circuit element REG. In the description of operation that follows and in the description of the invention that will come later it will be concentrated, for the sake of an example, on the regulation of a positive voltage, but it is clear to one skilled in the art that a negative voltage could be regulated as well. The first port 1 of the regulator is connected to the voltage source and the second port 2 to the ground plane, whereby there is an input voltage Vin between the ports. Between the third port 3 and the second port 2 there appears an output voltage Vout.

According to the operating principle of the regulator the output voltage Vout is lower than the input voltage Vin, and it is up to the regulator to keep the output voltage Vout constant regardless of the variations of the input voltage Vin. Each regulator has a smallest possible voltage difference Vin–Vout with which the output voltage remains at its constant value. This limit value is called the dropout voltage and hereafter it will be marked Vdropout in this document. If the input voltage Vin decreases to a value smaller than Vout+Vdropout, the regulator is no longer able to keep the output voltage Vout constant but it begins to follow the variations of the input voltage Vin. Another important performance value of the regulator, in addition to the dropout voltage, is the quiescent current, which means in the regulator and components connected directly to it the current from the operating voltage to the ground potential, ie. Vin to GND and Vout to GND.

An attempt is made to minimize the number of cells in batteries used as voltage sources in portable mobile phones in order to make the phones small and light-weight. As a result of this, the voltage level Vin coming from the battery to the regulator is low. Take a mobile phone for example with a battery including four cells having a nominal voltage of 1.2 volts. The cells are connected in series, making the nominal voltage of the battery 4.8 V. When the battery is fully charged, its terminal voltage is about 5.8 V. When the battery is connected to a phone, the full terminal voltage quickly drops to about 5.5 V because of the load. During use, the terminal voltage further decreases, until, when it reaches about 4.0 V, the use of the battery has to be stopped and the battery has to be recharged.

The dropout voltage Vdropout of normal general-purpose regulators, like those of the National LM 78 series, is about 2.0 to 2.5 V. If such a regulator were used in the mobile phone of our example, there would be only about a 1.5 to 2.0 V operating voltage Vout for the load fed by the regulator, with the battery voltage down to its lowest value. It is obvious that a voltage level this low is not sufficient but the device requires a so-called low dropout voltage regulator in which the dropout voltage is typically only about 0.3 V. Thus, the load voltage can be kept constant at 3.7 volts for the whole discharge cycle of the battery, even when the battery voltage is down to its minimum value, ie. 4.0 volts. In the discussion to follow it will be required that the output voltage, or the load voltage. Vout of the regulator is 3.7 V.

Known prior art low dropout voltage regulators usually employ a PNP type series transistor between Vin and Vout because with the PNP structure the internal voltage drop of the transistor is smaller than with the NPN structure. In such a regulator a great part of the quiescent current consists of the base current of the transistor which must be adjusted according to the load current required. The base current is almost directly proportional to the load current. For example, in a National LM2931 regulator the base current is 10% of the load current. In general-purpose regulators the base current of the PNP transistor has to be adjusted according to the maximum load current, whereby the optimal efficiency is achieved only when the device is operating at the maximum load current. A smaller load current means poorer efficiency, when efficiency is defined as the ratio of the electrical power used by the load and the electrical power taken from the battery by the regulator. A mobile phone is a typical example of a device in which the current consumption varies greatly according to the operating mode of the device. If a coupling similar to the regulator coupling discussed here is used in a mobile phone, the load current in the active (speech) state is typically about 2.5 times higher than the load current in the standby state.

In some known solutions the load current is measured and the base current of the PNP transistor is adjusted so that the base current is proportional to the instantaneous value of the load current. However, measuring the current requires that a series component be placed on the current path Vin to Vout. With a high load current the voltage drop in the series component increases the dropout voltage Vdropout, which is contradictory to the desired low dropout characteristic. Furthermore, current measurement circuits themselves draw current and make the coupling more complex, bigger in size, and more expensive to implement.

Figure 2:
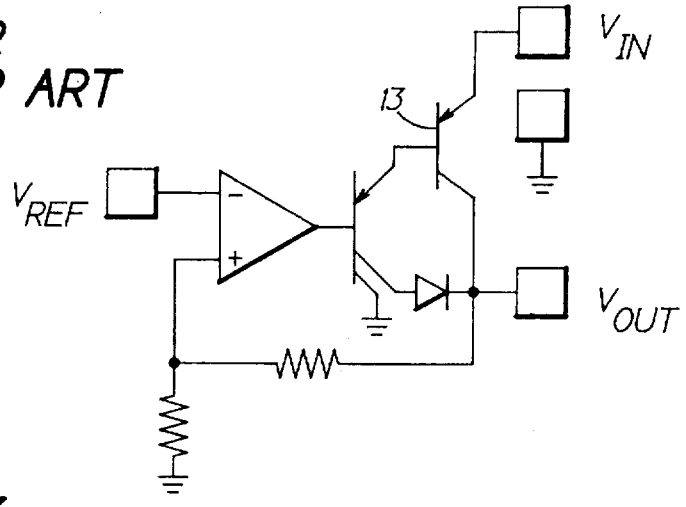
FIG. 2 PRIOR ART

It is also known to direct the base current of a PNP transistor 13 to the load. FIG. 2 shows a regulator coupling according to U.S. Pat. No. 4,613,809 seeking this kind of solution. In the descriptive part of the patent document it is mentioned that the quiescent current is directed to the load when the voltage difference Vin-Vout is more than 1.5 V. In the example case discussed above this means that current saving is functional only when the battery voltage is over 5.2 V and, therefore, the current saving achieved is of little practical significance.

U.S. Pat. No. 4,906,913 and FIG. 3 according to it show another coupling in which the base current of a PNP transistor 26 is directed to the load. In the descriptive part of the patent document it is mentioned that the current saving is functional with a lower dropout voltage than in the case of U.S. Pat. No. 4,613,809 due to the fact that there is one diode junction less than before on the base current path, which, with the assumed 0.6 V junction voltage, means current saving with a 0.9 V voltage difference Vin-Vout instead of 1.5 V. In our example case with four battery cells, no current saving is achieved when the battery voltage is between 4.0 V and 4.6 V. In addition, the differential amplifier 80 which belongs to the coupling draws quiescent current, although, according to the usual drawing practice, the figure shows no operating voltage connection for it.

It is the object of this invention to disclose a method and a circuit for reducing the power consumption of an electronic device, preferably a battery-powered device, thereby extending the operational time of the battery. The circuit according to the method should be simple in construction and it should be suitable for battery-powered devices the current consumption of which in the various operating modes is known and which operate at low operating voltages.

The invention utilizes the fact that the current consumption of a device in its various operating modes is known. The invention is based on a realization according to which the quiescent current of the regulator can be separately adjusted to the value required by each operating mode when these values are known beforehand. This arrangement avoids the disadvantages of prior art, like unnecessary current consumption when the load current varies and complex current or voltage measurement couplings with the additional problem of producing a low dropout voltage.

The basic idea of the invention is to arrange alternative base current paths in the regulator which are adjusted such that when they are connected in different ways between the base of a series transistor and the ground potential, the base current of the transistor is made to correspond to the load current value required by each operating mode and corresponding power consumption.

It is characteristic of the method according to the invention that the base current of the series transistor in at least one voltage regulator of the electronic device is made smaller at such moment of time when the regulator is not required to supply the maximum load current and this moment of time is known to the electronic device.

It is characteristic of an electronic device according to the invention that at least one extra intermediate input is placed in the voltage regulator of the device, and the voltage regulator of the device includes a current path to conduct the base current between the base of a series transistor and another point belonging to the coupling, and the current path includes a current regulating element with at least two states, in the first of which more current flows through the current regulating element than in the second, and said extra intermediate input is arranged to drive said current regulating element into the first or second state.

It is characteristic of a voltage regulator according to the invention that at least one extra intermediate input is arranged in it, and it includes a current path to conduct the base current between the base of a series transistor and another point belonging to the coupling, and the current path includes a current regulating element having at least two states, in the first of which more current flows through the current regulating element than in the second, and said extra intermediate input is arranged to drive said current regulating element into the first or second state.

In the method according to the invention the base current of the series transistor in the regulator coupling is not directed to the load like in prior an arrangements, but yet the savings achieved in the power consumption are better than in prior art solutions. The proportions of the current consumption values can be illustrated by taking a mobile phone for example with a current consumption of 25 mA in the standby state and 400 mA in the speech state. The current in the standby state and part of the current in the speech state flows through a regulator according to the invention. In a regulator coupling according to the invention, the technical details of which will be discussed later, the quiescent current that corresponds to the standby state is about 0.6 mA smaller than the quiescent current corresponding to the speech state. Current saving in the standby state is therefore 2.4% of the whole current consumption in the standby state. If the phone is in the standby state for the whole duration of the above-mentioned 40-hour service time of the battery, the service time of the battery will be extended by about an hour. In the speech state, said 0.6 mA increase in the quiescent current, which is not directed to the load and which is so in a way wasted, is about 0.15% of the whole current consumption, which shortens the above-mentioned two-hour speech time by only about 10 seconds. Thus the method according to the invention, based on minimizing the quiescent current at those times when no full load current is required of the regulator coupling, provides significant advantages.

The invention will be described in detail using a preferred embodiment as an example and referring to the enclosed drawing, where FIG. 1 shows a diagram of the operation of the voltage regulator and its position in the electric circuit.

Figure 3:
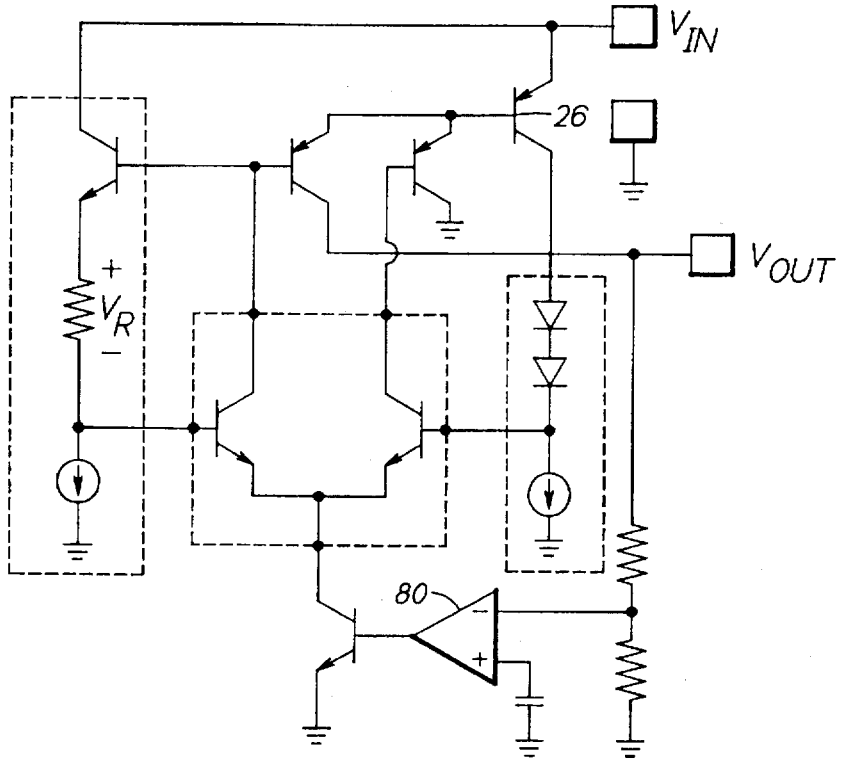
FIG. 3 PRIOR ART

FIG. 2 shows a regulator coupling known from U.S. Pat. No. 4,613,809 in which the base current of the series transistor is taken to the load, FIG. 3 shows another regulator coupling known from U.S. Pat. No. 4,906,913 in which the base current of the series transistor is taken to the load, FIG. 4 shows a coupling according to a preferred embodiment of the invention, FIG. 5 shows a variation of the coupling of FIG. 4, and FIG. 6 is a block diagram showing circuitry of a mobile telephone that includes a voltage regulator in accordance with the invention.

FIGS. 1,2, and 3, which relate to prior art, were already discussed, so the invention is below described with reference mainly to FIGS. 4 and 5.

Figure 6:
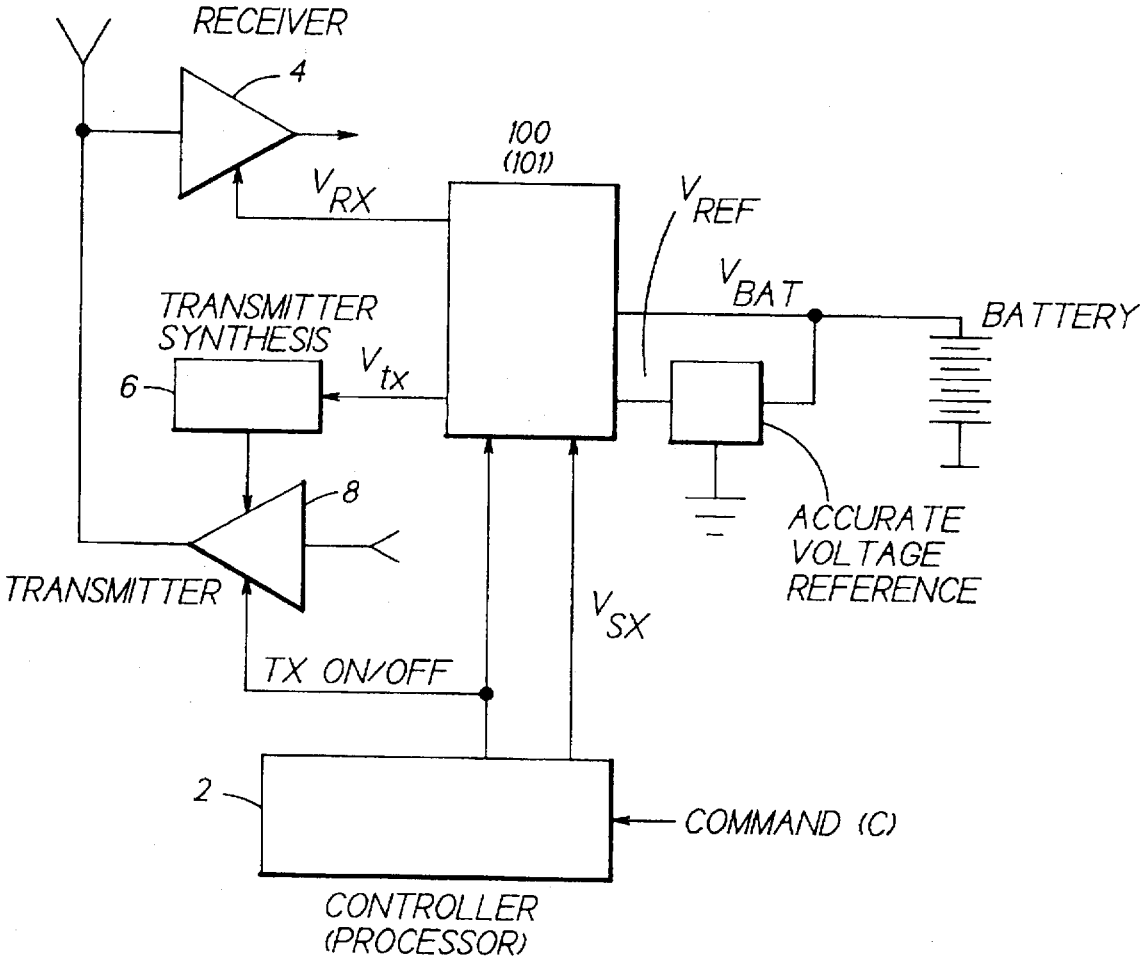

FIG. 6, a block diagram of circuitry of a mobile telephone 1 is shown. The circuitry includes a receiver 4, a transmitter synthesis circuit 6, a transmitter 8, a controller (processor) 2, a battery, an accurate voltage reference circuit having a voltage reference Vref, and a regulator coupling or circuit (designated as 100 or 101) of the invention.

Figure 4:
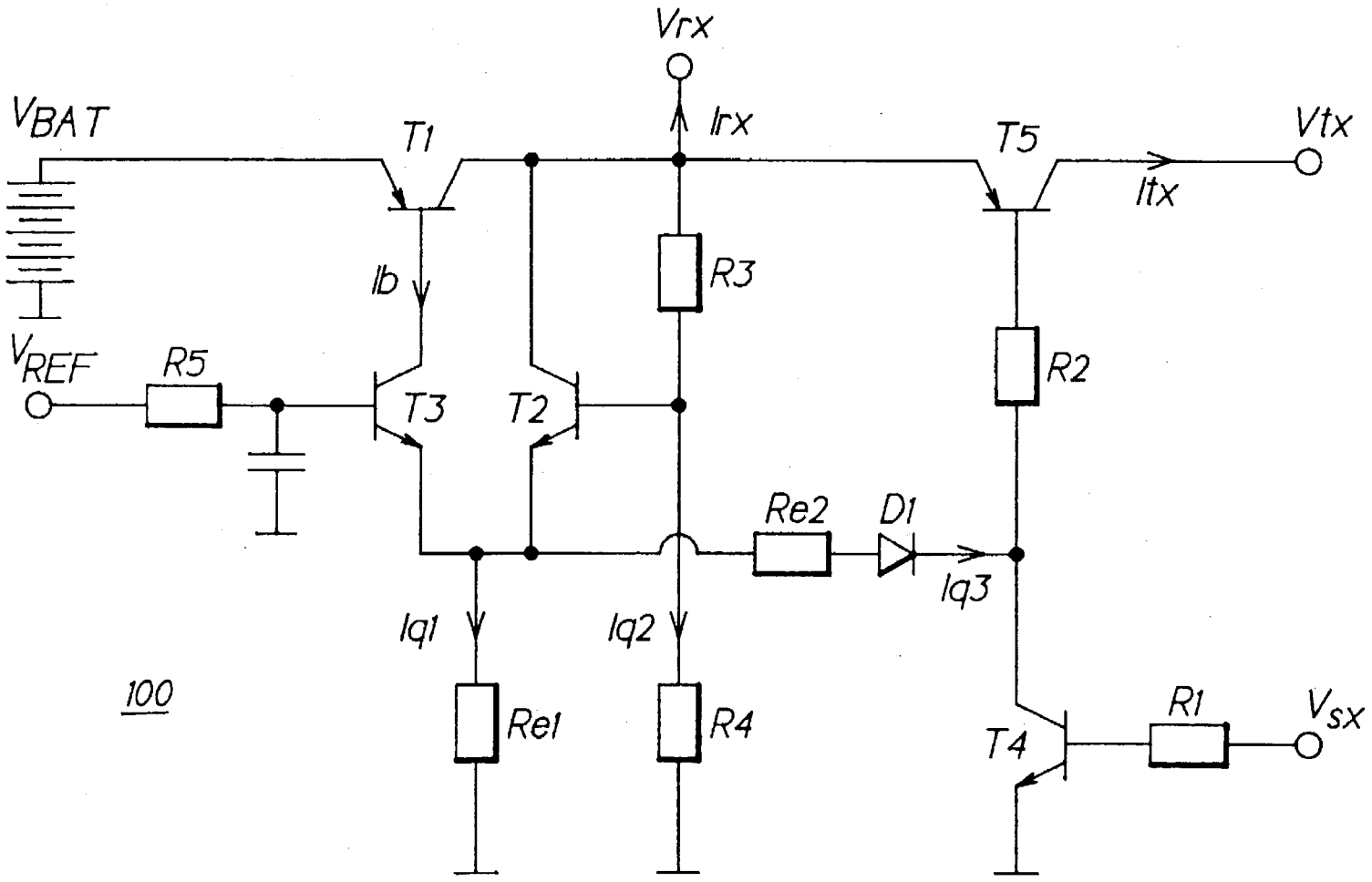
Figure 5:
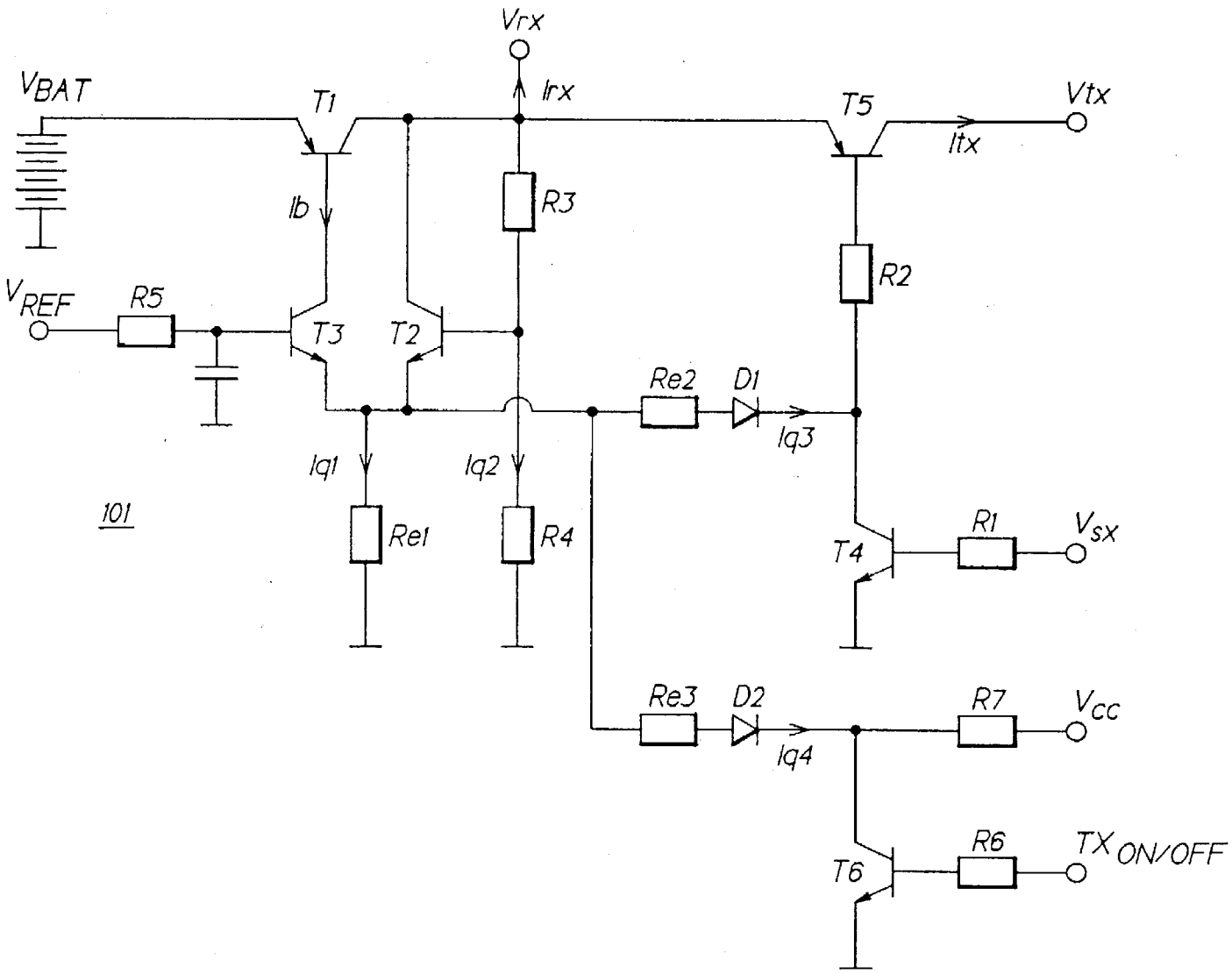

FIG. 4 shows the regulator coupling 100, which feeds the receiver 4 and the transmitter synthesis circuit 6 of FIG. 6. Various other reference labels are shown in FIGS. 4 and 6. These reference labels represent various elements of the coupling 100 and the mobile telephone 1. For example:

Vbat represents the battery voltage (e.g., 4.0 V to 5.5 V for a four cell battery);

Vref represents the accurate reference voltage (e.g., 3.3 V);

Vrx represents an operating voltage (e.g., 3.7 V) of the receiver 4;

Vtx represents an operating voltage (e.g., 3.5 V) of the transmitter synthesis circuit 6;

Vsx represents a switching voltage used to switch Vtx on and off (0V/3.3 V);

Iq1 represents a quiescent current passing through a resistor Re1;

Iq2 represents a quiescent current passing through a resistor R4;

Iq3 represents a quiescent current passing through a resistor Re2, a diode D1, and a transistor T4;

Irx represents current (e.g., 25 mA) that is drawn by the receiver 4;

Itx represents current (e.g., 40 mA) that is drawn by the transmitter synthesis circuit 8; and Command (C) represents a call message or an action by a user of the telephone 1 indicating that the telephone 1 be switched from a standby state into a speech state.

The receiver circuit voltage Vrx is always on while power to the phone 1 is switched on, but the operating voltage Vtx of the transmitter synthesis circuit 6 is on only when the phone 1 is in the speech state or updating its location in the cellular network. Time spent by the phone 1 in the speech state is typically very short compared with the standby time during which only the receiver circuits are switched on. It is very important to minimize the current consumption of the phone 1 in the standby state. If the regulator's quiescent current is adjusted according to the current consumption in the speech state, electrical power will be wasted during the standby state. In our example case the base current of the transistor T1 is in the speech state about 2.5 times bigger than in the standby state because the load current flowing through the regulator 100 is 25 mA in the standby state and 65 mA in the speech state.

The regulator's load current is defined as the sum of the currents drawn by the loads fed by the regulator 100; in this case the load current is Irx+Itx.

The regulator circuit 100 to the invention uses a switching signal Vsx with which the processor 2 of the phone switches the operating voltage Vtx to the transmitter stages in the beginning of the speech state. In the invention the same signal is used to control the base current of the transistor T1 so that the base current is increased for the duration of the speech state, whereby the load current Irx+Itx is high.

Transistors T5 and T4 and resistor R2 constitute a switching circuit which the processor 2 uses to switch on the operating voltage Vtx of the transmitter synthesis circuit 6. Transistor T4 controls transistor T5 so that when Vsx is positive (in our example, 3.3 V) T4 is in conductive state and its collector is almost at the ground potential. The potential of the base of transistor T5 is then about 0.6 V lower than the load voltage Vrx of the receiver 4. When the control voltage Vsx is zero, the collector voltage of transistor T4 is higher than the voltage at the common emitter point of transistors T2 and T3.

Differential pair T2/T3 serves as a voltage controller for the regulator 100. An accurate reference voltage Vref is brought to the base of transistor T3. Since the emitters of transistors T2 and T3 are connected together, there appears at the base of T2 the same voltage as at the base of T3. A feedback is arranged to the controller 2 from the collector of the series transistor T1 by means of a voltage divider comprising resistors R3 and R4. If the output voltage is about to change, indication of that is brought to the base of transistor T2, and the differential pair immediately corrects the error. Because there are no time constants in the adjustment circuit that would slow down the feedback, there will not occur voltage swinging due to slowness of adjustment. The regulator output voltage is determined on the basis of the mutual relation of resistances R3 and R4. The resistor resistances are selected as high as possible so that the current flowing through them will not increase current consumption. They can be selected such that current Iq2 flowing through resistors R3 and R4 is insignificant in comparison with the base current Ib of transistor T1.

The series transistor in our example coupling 100 is a PNP type transistor T1 whose emitter-collector saturation voltage is low, typically less than 200 mV with maximum load current. When the circuit is operational, the transistor T1 is essentially all the time in saturation mode in order to keep the voltage drop thereover as small as possible. There are no other series components on the current path Vin to Vout, so the voltage drop of the regulator 100 is small. The base current of transistor T1 is determined on the basis of the resistance between the common emitter point of transistors T2 and T3 and the ground potential. In order for the coupling 100 to comply with the present invention the base current Ib of transistor T1 must be adjustable between certain values according to the load. In our example case, resistor Re1 is coupled directly to the ground potential from the common emitter point of T2 and T3. In addition, from the same point a series circuit comprising resistor Re2 and diode D1 is coupled to the collector of the driver transistor T4 in a way such that when T4 is in the conductive state, the cathode of diode D1 is coupled to the ground potential and resistor Re2 is thereby coupled in parallel with resistor Re1 via diode D1. reducing the resistance of the base current path of the series transistor T1, which increases the base current Ib. Transistor T4 is made conductive by a positive control voltage Vsx, the main purpose of which is to connect the operating voltage Vtx to the transmitter synthesis circuit 6. Diode D1 prevents the differential pair T2/T3 serving as a voltage controller from being disturbed when transistor T4 is not in the conductive state and its collector has a higher potential than the emitter point of the differential pair T2/T3.

The invention is not restricted to changing the base current of a series transistor between two values. The device in which the regulator 100 is used may have several operating modes, each of which has a typical and predetermined load current Irx+Itx. The example coupling 100 of FIG. 4 described above can be adapted to such situations by adding alternative current paths between the emitter point of transistors T2 and T3 and the ground potential, as shown in FIG. 5. In FIG. 5, a regulator circuit or coupling 101 is shown which is similar to the regulator circuit 100 of FIG. 4. However, in the regulator 101 shown in FIG. 5, one alternative current path is added, which constitutes a series circuit comprising a resistor Re3, protective diode D2, and transistor T6 serving as a switch, having a control signal TX on/off of its own. Each alternative current path comprises a resistive element, protective diode and a switching element. Of these the protective diode is necessary only if the current path is coupled in a way such that it otherwise in one of its states would connect the emitter point of transistors T2 and T3 to a higher potential.

Control voltages Vsx and TX on/off are brought to the regulator coupling 101 from an external circuit which controls the timing of the operation of the device. In the mobile phone 1, this device is the processor 2, which on the basis of a command (C) (e.g., a call message or an action by the user) input into the processor 2 finds that the phone has to be switched from the standby state into the speech state and switches by means of the control voltage Vsx and transistors T4 and T5 the operating voltage Vtx of the transmitter synthesis circuit 6 on. If the phone 1 has several operating modes and the regulator 101 has, as described above, several alternative current paths for the base current of the series transistor, the control signals for the coupling of these current paths, with the TX on/off as an example, are taken correspondingly from the signals issued by the processor 2 that indicate the beginning of each operating mode.

Constant-current generators are known, and they may also be used to set the base current Ib of the series transistor T1 to the desired values. In our example coupling, a constant-current generator would be coupled in the place of the series circuit comprising resistor Re2 and diode D1. If the regulator coupling and current regulating circuit are integrated in the same IC, the constant-current generator is preferably a current mirror, which is a circuit element known to one skilled in the art.

The base current of the series transistor may also be taken through a current path in which the states of the switching element correspond not only to the open and closed positions. If the switching element (T4; T6) is a bipolar transistor according to FIGS. 4 and 5, a bigger or smaller current can be taken through the current path by changing the base voltage (Vsx; TX on/off) of the transistor in small steps. Then the base voltage of the switching transistor (T4; T6) cannot be taken directly from the processor 2 or other digital circuit controlling the operation of the regulator but e.g. through a suitable D/A conversion. In the invention, the idea is to avoid measuring the load current of the regulator so that the regulator's low dropout characteristic can be maintained, and therefore, according to the invention, also said changes in the base current of the series transistor T1 carried out in small steps are designed beforehand to correspond to certain operating modes of the device to which the regulator is feeding electrical power.

By means of the invention it is possible in a simple manner to reduce the current consumption of an electronic device which includes at least one regulator, by setting the base current of a series transistor in the regulator to correspond to the value of a particular load current. The invention is applicable in various types of electronic devices, especially battery-powered devices, such as mobile phones, portable computers, portable fax machines, portable photocopiers, portable oscilloscopes and other portable instruments, and e.g. portable hospital equipment and so on, thereby extending the operating time of the battery.

I claim:

1. A method for reducing an amount of power consumed by an electronic device, the electronic device comprising device, the electronic device comprising at least one voltage regulator and a controller located externally to the voltage regulator, the voltage regulator including a transistor, the electronic device being operable in any one of at least two states, wherein in a first one of the states a first amount of load current is required to flow through the transistor to power at least a first one and a second one of a plurality of loads of the electronic device, and wherein in a second one of the states a second, lesser amount of load current is required to flow through the transistor to power only the first one of the plurality of loads of the electronic device, wherein for each of the states the transistor is connected in series with the load current flowing through the transistor, the method comprising the steps of:

detecting, with the controller of the electronic device, a command input into the controller indicating that the electronic device begin operating in the second state; and reducing an amount of base current flowing through a base of the transistor, in response to a detection of the command input into the controller.

2. A method as set forth in claim 1, wherein the voltage regulator further includes at least two branches, wherein a first one of the branches directs the base current of the transistor to ground, wherein at least a second one of the branches includes a switching element which is operable in one of an open state and a closed state, wherein in the closed state at least a portion of the base current flows through the second branch to ground, and wherein the step of reducing is performed by setting the switching element into the open state.

3. A method as set forth in claim 1, wherein the voltage regulator further includes a base current path that includes a current regulating element which is operable in one of an open state and a closed state, wherein in the closed state more base current flows through the current regulating element than in the open state, and wherein the step of reducing is performed by switching the current regulating element from the closed state to the open state.

4. A method as set forth in claim 1, wherein the step of reducing is performed at a time when the electronic device is on but is functionally in a passive state.

5. A method as set forth in claim 1, wherein the electronic device includes a mobile telephone, and wherein the step of reducing is performed at a time at which the mobile phone is switched into a current-saving state.

6. A method as set forth in claim 1, wherein the electronic device includes a cellular mobile telephone in a mobile telephone system having base stations and a control channel for traffic between a base station and the cellular mobile telephone, and wherein the step of reducing is performed to reduce the base current of the transistor for a period of time between two successive control channel messages received from the base station.

7. A method as set forth in claim 1, wherein the electronic device includes a mobile telephone, wherein in the first state the mobile telephone is operating in a speech state, and wherein in the second state the mobile telephone is operating in a standby state.

8. An electronic device including at least one voltage regulator (100; 101) which includes a series transistor (T1) connected in series as regards the load current (Irx+Itx) flowing through the voltage regulator (100; 101), wherein at least one extra intermediate input (Vsx) is placed in the voltage regulator (100; 101) of the device, and the voltage regulator (100; 101) of the device includes a current regulating element (T4) and a current path having at least two current branches (Re2, D1; Re1), said current regulating element (T4) having at least two states, wherein in a first one of the states a base current (Ib) of the series transistor (T1) is conducted to a ground potential via the first one of the current branches (Re2, D1) and more current flows through the current regulating element (T4) than in a second one of the states, wherein said extra intermediate input (Vsx) is made to drive said current regulating element (T4) into the first state or the second state; and wherein said voltage regulator (100; 101) includes:

a reference voltage input;

a differential pair formed by transistors, including a first transistor (T3) and a second transistor (T2), the emitters of which are connected together;

a voltage divider (R3, R4);

a switching transistor (T5), and a first output port (Vrx) and a second output port (Vtx), wherein:

the base of the series transistor (T1) is coupled to the collector of the first transistor (T3) of the differential pair, and a reference voltage (Vref) is coupled to the base of said first transistor (T3);

the output of the series transistor (T1) is coupled to the collector of the second transistor (T2) of the differential pair, and a feedback voltage is coupled to the base of said second transistor (T2) from the series transistor output via said voltage divider;

a second one of the current branches (Re1) is coupled from the common emitter point of the differential pair to the ground potential, and the first current branch (Re2, D1) is coupled from the same point via the current regulating element (T4) to the ground potential;

the first output port (Vrx) is coupled to the output of the series transistor (T1) and the second output port (Vtx) is coupled via the switching transistor (T5) to the output of the series transistor (T1);

the base of the switching transistor (T5) is coupled via the current regulating element (T4) to the ground potential; and the base of the current regulating element (T4) is coupled to the extra intermediate input (Vsx).

9. The electronic device of claim 8, wherein the second current branch is for conducting the base current (Ib) between the base of said series transistor (T1) and the ground potential.

10. The device of claim 8, characterized in that at least one of said current branches includes a constant-current generator.

11. The device of claim 10, characterized in that said constant-current generator is implemented with a current mirror coupling.

12. A voltage regulator for regulating the voltage obtained from a voltage source (Vbat), including a series transistor (T1) connected in series as regards the load current (Irx+Itx) flowing through the regulator, characterized in that it includes an extra intermediate input (Vsx), a current regulating element (T4), and a current path having at least two current branches (Re2, D1; Re1), said current regulating element (T4) having at least two states, in the first of which a base current (Ib) of the series transistor (T1) is conducted to ground potential via the first current branch (Re2, D1) and more current flows through the current regulating element (T4) than in a second one of the states, wherein said extra intermediate input (Vsx) is made to drive said current regulating element (T4) into the first state or the second state; wherein the voltage regulator includes:

a reference voltage input;

a differential pair formed by transistors, including a first transistor (T3) and a second transistor (T2), the emitters of which are connected together;

a voltage divider (R3, R4);

a switching transistor (T5); and a first output port (Vrx) and a second output port (Vtx); wherein:

the base of the series transistor (T1) is coupled to the collector of the first transistor (T3) of the differential pair and a reference voltage (Vref) is coupled to the base of the first transistor (T3);

the output of the series transistor (T1) is coupled to the collector of the second transistor (T2) of the differential pair and a feedback voltage is coupled to the base of the second transistor (T2) from the series transistor output via said voltage divider (R3, R4);

a second one of the current branches (Re1) is coupled from the common emitter point of the differential pair to the ground potential, and the first current branch (Re2, D1) is coupled from the same point via the current regulating element (T4) to the ground potential;

the first output port (Vrx) is coupled to the output of the series transistor (T1) and the second output port (Vtx) is coupled via the switching transistor (T5) to the output of the series transistor (T1);

the base of the switching transistor (T5) is coupled via the current regulating element (T4) to the ground potential; and the base of the current regulating element (T4) is coupled to the extra intermediate input (Vsx).

13. The voltage regulator of claim 12, wherein the second current branch is for conducting the base current (Ib) between the base of said series transistor (T1) and the ground potential.

14. The voltage regulator of claim 12, characterized in that at least one of said current branches includes a constant-current generator.

15. The voltage regulator of claim 14, characterized in that said constant-current generator is implemented with a current mirror coupling.

* * * * *